US008149071B2

(12) United States Patent
Ryou et al.

(10) Patent No.: US 8,149,071 B2
(45) Date of Patent: Apr. 3, 2012

(54) RADIO FREQUENCY SWITCH AND APPARATUS CONTAINING THE RADIO FREQUENCY SWITCH

(75) Inventors: Byung Hoon Ryou, Seoul (KR); Won Mo Sung, Siheung-si (KR); Dong Ryul Shin, Daegu (KR); Chang Hyun Park, Incheon (KR); Bong Suk Choi, Seoul (KR)

(73) Assignee: EMW Co., Ltd., Incheon (KR)

( * ) Notice: Subject to any disclaimer, the term of this patent is extended or adjusted under 35 U.S.C. 154(b) by 271 days.

(21) Appl. No.: 12/525,670

(22) PCT Filed: Feb. 4, 2008

(86) PCT No.: PCT/KR2008/000649

§ 371 (c)(1),
(2), (4) Date: Sep. 28, 2009

(87) PCT Pub. No.: WO2008/096989

PCT Pub. Date: Aug. 14, 2008

(65) Prior Publication Data

US 2010/0073112 A1 Mar. 25, 2010

(30) Foreign Application Priority Data

Feb. 5, 2007 (KR) ..... 10-2007-0011819

(51) Int. Cl.
*H01P 1/15* (2006.01)
*H01P 3/08* (2006.01)

(52) U.S. Cl. ..... 333/103; 333/246

(58) Field of Classification Search ..... 333/101, 333/103, 104, 105, 236, 238, 246
See application file for complete search history.

(56) References Cited

U.S. PATENT DOCUMENTS 4,267,538 A 5/1981 Assal et al.
(Continued)

FOREIGN PATENT DOCUMENTS

| | | |
|---|---|---|
| JP | 2002203924 A | 7/2002 |
| JP | 2007-049665 | 2/2007 |
| WO | WO 02/09224 A1 | 1/2002 |

OTHER PUBLICATIONS

PCT International Search Report for PCT Counterpart Application No. PCT/KR2008/000649 containing Communication relating to the Results of the Partial International Search Report, 2 pgs., (May 16, 2008).

(Continued)

*Primary Examiner* — Dean O Takaoka
(74) *Attorney, Agent, or Firm* — Blakely, Sokoloff, Taylor & Zafman LLP.

(57) ABSTRACT

The present invention relates to A radio frequency (RF) switch and an apparatus including the RF switch. In an aspect of the present invention, an RF switch includes a transmission line having one end connected to an input terminal or an output terminal and the other end connected to a signal line and configured to transfer an RF signal, and a diode disposed between the input terminal and the transmission line or between the output terminal and the transmission line, the diode being configured to control whether or not to transmit the RF signal. In another aspect, an RF switch includes a transmission line having one end connected to an input terminal and the other end connected to an output terminal, and a diode disposed between the input terminal and the transmission line or between the output terminal and the transmission line, the diode being configured to control whether or not to transmit the RF signal. Here, a CRLH (Composite Right/Left-Handed) transmission line is employed as the transmission line.

8 Claims, 4 Drawing Sheets

U.S. PATENT DOCUMENTS

| | | | | |
|---|---|---|---|---|
| 7,123,884 | B2 | 10/2006 | Nakakubo et al. | |
| 7,675,384 | B2 * | 3/2010 | Itoh et al. | 333/118 |
| 7,839,216 | B2 * | 11/2010 | Alidio et al. | 330/295 |
| 7,839,236 | B2 * | 11/2010 | Dupuy et al. | 333/136 |
| 2002/0180558 | A1 | 12/2002 | Atokawa et al. | |
| 2010/0019861 | A1 * | 1/2010 | Ryou et al. | 333/103 |
| 2010/0171563 | A1 * | 7/2010 | Dupuy et al. | 333/103 |

OTHER PUBLICATIONS

Supplementary European Search Report pertaining to corresponding European application (EP 08712301.4), 3pgs, mailed Mar. 22, 2011.

European Office Action for counterpart application No. EP 08712301.4: 5 pgs., mailed Apr. 4, 2011.

Hoang V. Nguyen et al., "Metamaterial-Based Dual-Band Six-Port Front-End for Direct Digital QPSK Transceiver," IEEE Melecon, pp. 363-366 (May 2006).

I-Hsiang Ling et al., "Arbitrary Dual-Band Components Using Composite Right/Left-Handed Transmission Lines," IEEE Transactions on Microwave Theory and Techniques. vol. 52, No. 4, pp. 1142-1149 (Apr. 2004).

* cited by examiner

[Fig. 1]
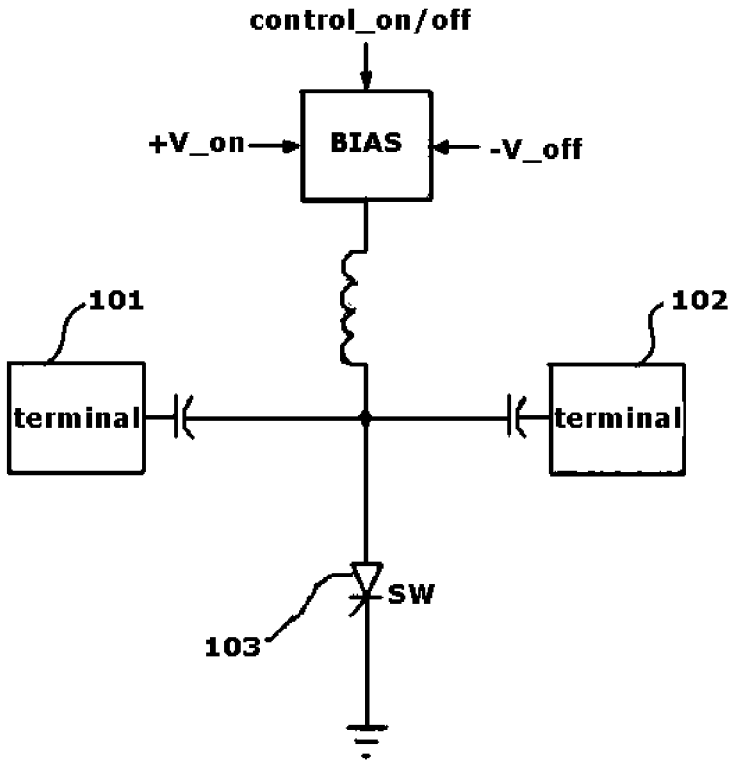
[Fig. 2]
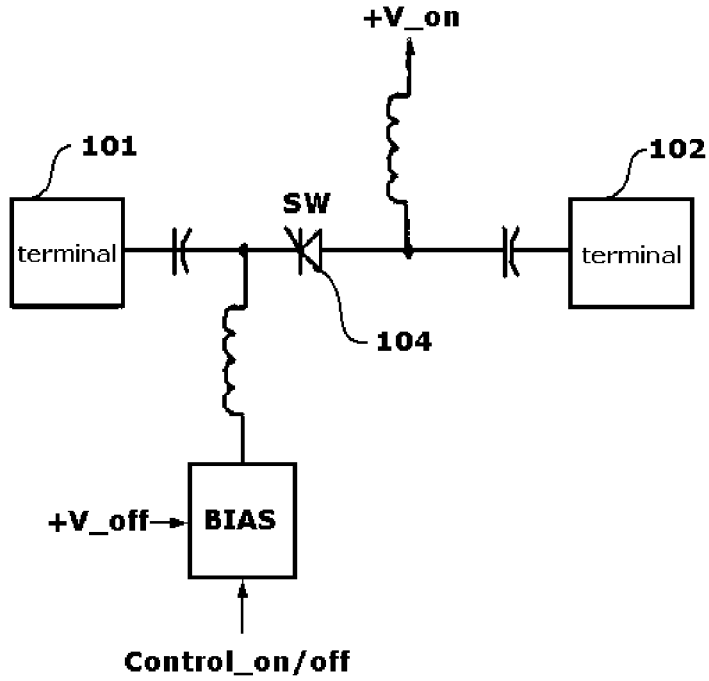

[Fig. 3]
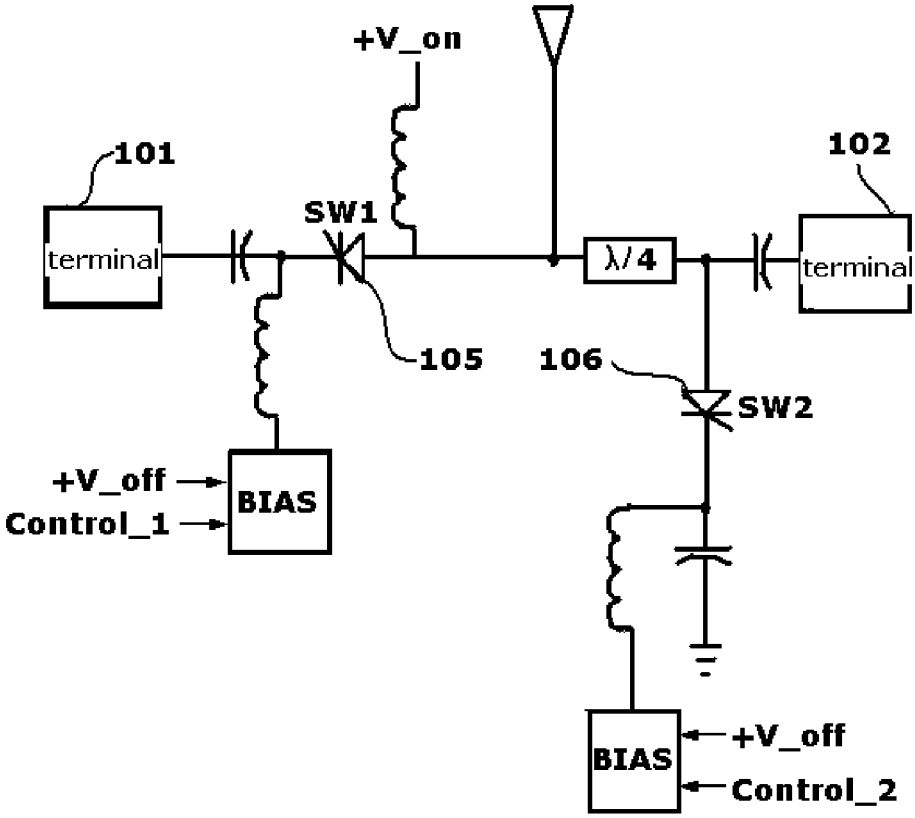
[Fig. 4]
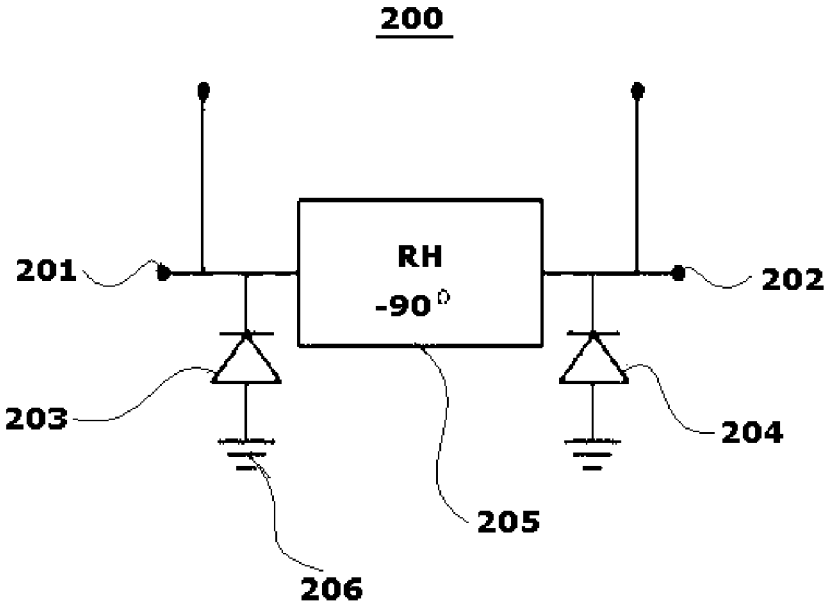

[Fig. 5]
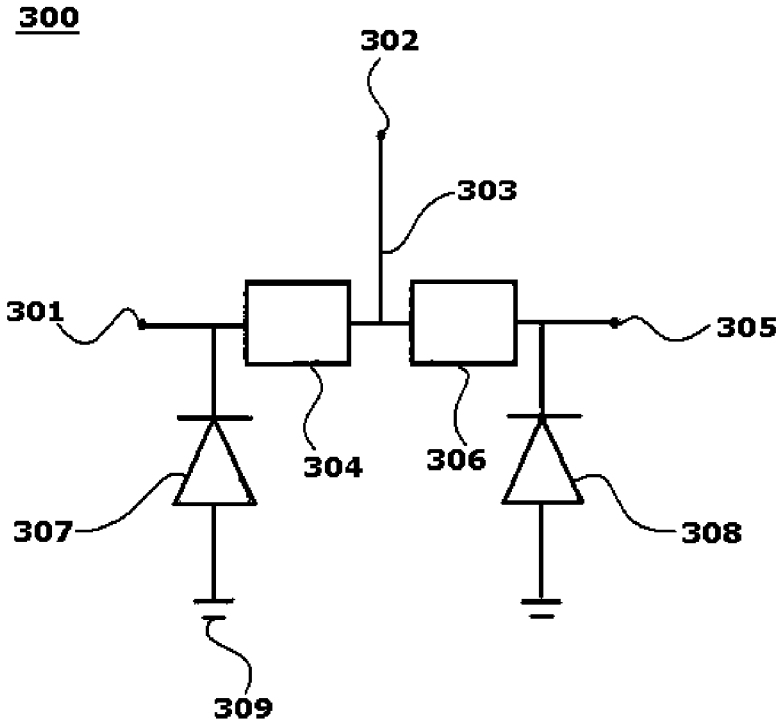
[Fig. 6]
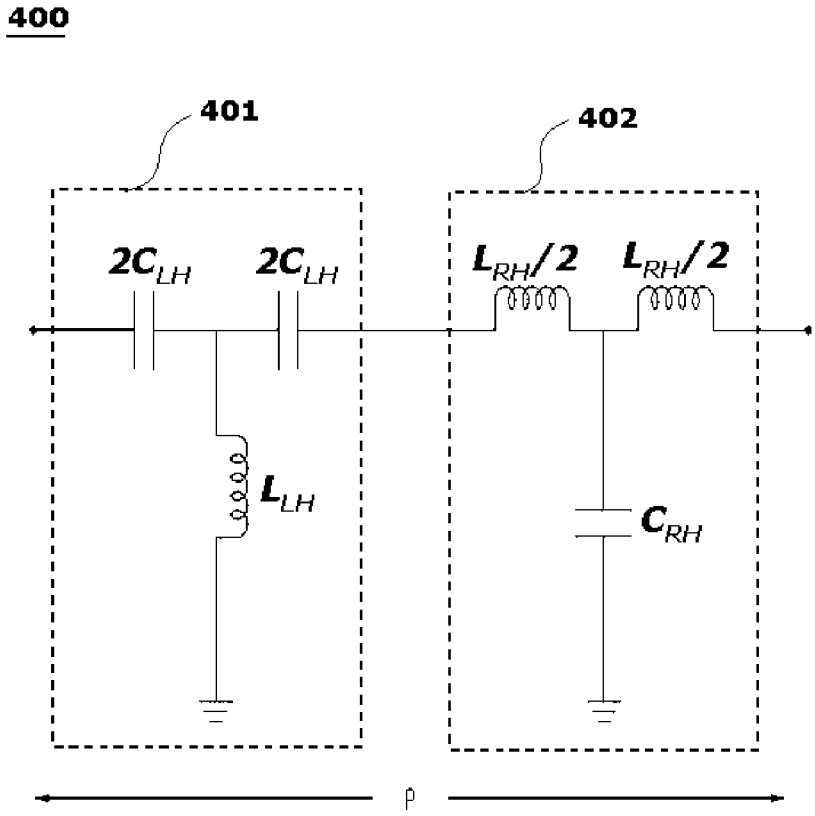

[Fig. 7]
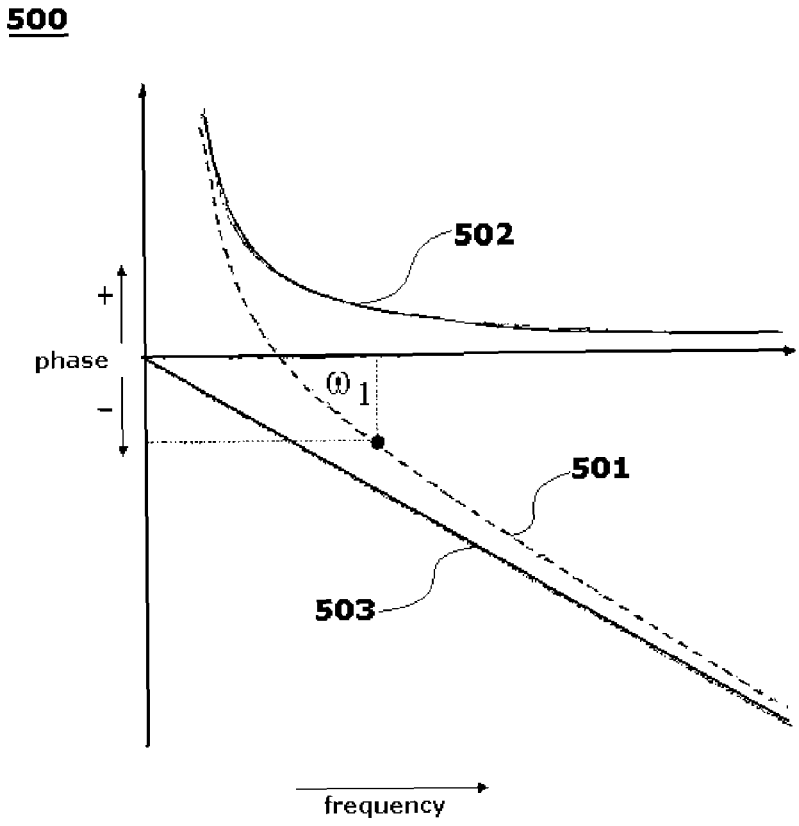
[Fig. 8]
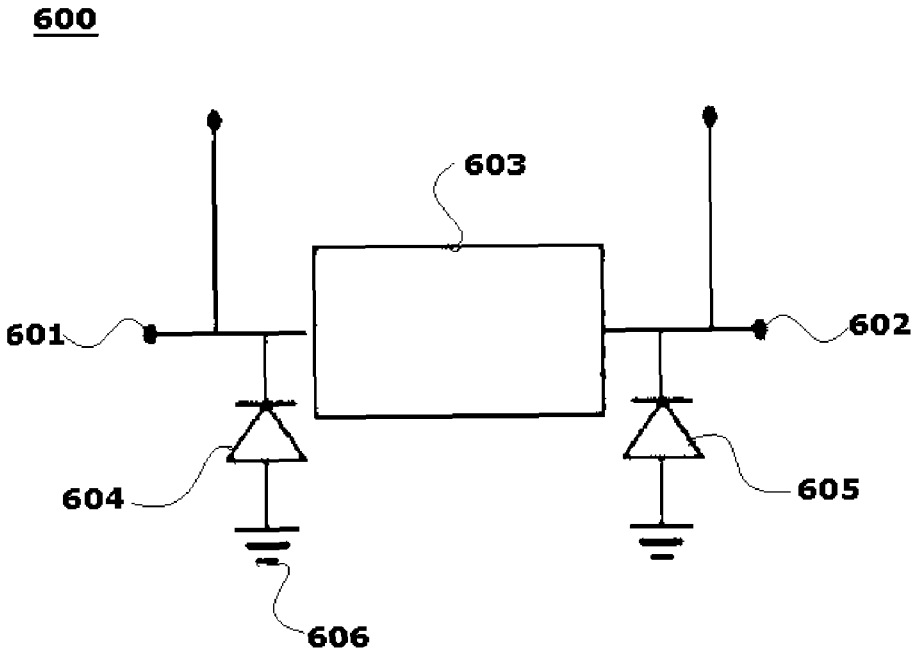

RADIO FREQUENCY SWITCH AND APPARATUS CONTAINING THE RADIO FREQUENCY SWITCH

CROSS-REFERENCE TO RELATED APPLICATIONS

This patent application is a U.S. National Phase application under 35 U.S.C. §371 of International Application No. PCT/KR2008/000649, filed on Feb. 4, 2008, entitled RADIO FREQUENCY SWITCH AND APPARATUS CONTAINING THE RADIO FREQUENCY SWITCH, which claims priority to Korean patent application number 10-2007-0011819, filed Feb. 5, 2007.

TECHNICAL FIELD

The present invention relates to A radio frequency (RF) switch and an apparatus including the RF switch, and more particularly, to an RF switch, which can be miniaturized while having a high linearity and a high degree of isolation even at a high power, and a short switching time, and has a dual band characteristic, and an apparatus including the RF switch.

BACKGROUND ART

An RF switch is an electrical on-off switch for an RF signal. When the RF switch is turned "on", it functions to have an RF signal, applied to its input terminal, normally transmitted to its output terminal, and when the RF switch is turned "off", it functions to hinder the RF signal from being transmitted to the output terminal. This "on" and "off" operation of the RF switch is changed depending on the polarity of a DC-controlled voltage that controls the RF switch.

This RF switch has a variety of types. The most basic types can include a Single-Pole/Single-Throw (SPST) switch having one RF signal input and one RF signal output and a Single-Pole/Multiple-Throw (SPMT) switch having one RF signal input and several RF signal outputs.

This electrical switching of the RF switch is performed by a diode, preferably, an RF switching diode known as a PIN diode. The PIN diode is a constitutional element that plays a pivotal role in an electrical circuit of the RF switch. As well known to those having ordinary skill in the art, the PIN diode is a semiconductor element having two terminals. In the PIN diode, current flows only in one direction from the anode terminal (anode side) to the anode terminal (cathode side) like other diodes, and when a positive voltage is applied to the anode, the diode is forward biased, so the current flows.

When the diode is biased so that the current can flow therethrough, that is, when the diode is forward biased, the diode provides resistance that is very low or almost zero so that the current can flow therethrough. This state is called an "on" state. When the diode is biased in an opposite direction, that is, when the diode is reverse biased, the diode provides infinitely high resistance to thereby form an open circuit, so the current cannot pass through the diode normally. This state is called an "off" state.

The diode requires a predetermined time when one state shifts to the other state according to a change in the voltage. This characteristic pertaining to the diode is called a transition time. To change the state of the diode, a new voltage for biasing the diode to another state must be applied to the diode during a minimum transition time of the diode.

An AC signal, such as an RF voltage added to a reverse-biased DC-controlled voltage, does not change the state of the PIN diode. This AC signal has a sufficiently high frequency.

Thus, when the duration of the voltage swings or peaks in the signal does not satisfy a minimum time required for the transition from the "on" state to the "off" state of the diode, the state of the PIN diode is not changed. However, the state of the diode can be changed by changing the polarity of the DC-controlled voltage in order to forward bias the diode, so that the current, including AC, can flow through the diode.

Further, when the diode is forward biased, an AC signal added to a forward-biased DC-controlled voltage does not change the state of the diode as long as it has a sufficiently high frequency, in the same manner that the diode is reverse biased. Meanwhile, if an AC voltage is too high, the added signal can exceed the breakdown voltage of the diode and break the diode. Thus, in the PIN diode, the breakdown voltage of the diode must be selected not to exceed an added AC signal.

Further, in constructing the RF switch, a shunt RF switch is advantageous in employing an electrical characteristic of the PIN diode. A PIN diode is branched and placed on an RF transmission line and then reverse biased by a control voltage. Thus, the diode serves as an open circuit, so an RF signal is propagated to an output terminal of the diode along the transmission line.

However, if the diode is forward biased so that the current flows therethrough, it provides a path having very small impedance with respect to the RF signal. The RF signal forms a shunt path from the transmission line to the ground via the diode and, therefore bypasses the transmission line to the output terminal. Hence, the RF signal does not pass through the transmission line. FIGS. 1 to 3 are examples showing a conventional RF switch. There are illustrated RF switches including PIN diodes 103, 104, 105 and 106 between two terminals 101,102 in various ways.

Meanwhile, in the case of a TDM (Time Division Multiplexing) transmission/reception system in which an RF signal is transmitted and received through one antenna, a SPDT (Single-Pole/Double-Throw) type RF switch, which can switch a transmission stage and a reception stage, is required. In this system, RF switches placed at the end and first stages require such characteristics as 1) high linearity with respect to a high power, 2) low insertion loss, 3) high isolation, 4) short switching time, and so on.

However, the conventional RF switch can be miniaturized since it is fabricated in a PIN diode switch form using a H-MIC (Hybrid-Microwave Integrated Circuit) technology, but has problems in that the fabrication process is complicated, there are limitations in the use of a high power, such as a relay, and the design of a specific dual band.

FIG. 4 is an example showing another conventional RF switch of a SPDT structure employing a PIN diode. An RF switch 200 is a PIN diode switch of a surface mounting type STDT structure for solving the above problems, and includes a transmission line 205 having an electrical length of −90 degrees with respect to PIN diodes 203, 204 between two terminals 201, 202. Here, as described above, if a forward bias is applied to the RF switch, the PIN diode 203 has low impedance close to short. As the electrical length of the transmission line 205 is set to −90 degrees, the impedance of the terminal 202 with respect to the terminal 201 becomes infinite. Consequently, a signal input through the terminal 201 is introduced to a ground 206 through the PIN diode 203, which is connection in parallel to the ground, but is rarely introduced to the transmission line 205. In other words, the PIN diode 203 becomes an "off" state. As described above, power loss can be minimized by employing the PIN diode and the RH transmission line 205 (that is, a ¼ line of a guided wavelength).

This RF switch has a high linearity and a high degree of isolation even at a high power, and a short switching time. However, the RF switch is problematic in that it becomes bulky when designing a low frequency band since the transmission line having the electrical length of −90 degrees is employed and it has a limitation in the use of a specific dual band.

SUMMARY

Accordingly, the present invention has been made in view of the above problems occurring in the prior art, and the present invention proposes new technologies concerned with an RF switch and an apparatus including the RF switch.

An object of the present invention is to design an RF switch, which can be miniaturized by employing a composite right/left-handed (CRLH) transmission line as a transmission line, while having a high linearity and a high degree of isolation even at a high power, and a short switching time through a PIN diode, and has a dual band characteristic.

Another object of the present invention is to design an RF switch, which can implement a high degree of isolation even in the SPST structure as well as the SPDT structure and can be miniaturized even at a single frequency band.

To achieve the above objects and solve the above problems, according to an embodiment of the present invention, there is provided an RF switch that switches an input and output of an RF signal, including a transmission line having one end connected to an input terminal or an output terminal and the other end connected to a signal line, the transmission line being configured to transmit the RF signal, and a diode disposed between the input terminal and the transmission line or between the output terminal and the transmission line, the diode being configured to control whether or not to transmit the RF signal. A CRLH transmission line is employed as the transmission line.

In accordance with an aspect of the present invention, the CRLH transmission line may include at least one cell that can be equalized through a combination of a RH transmission line including two serial inductors and a parallel capacitor, and a LH transmission line including two serial capacitors and a parallel inductor.

In accordance with another aspect of the present invention, the RH transmission line may generate positive phase delay at a high frequency band with respect to an input signal, and the LH transmission line may generate negative phase delay at a low frequency band with respect to the input signal.

In accordance with still another aspect of the present invention, the diode may have one end connected to the transmission line and the other end connected to a ground. This is for the purpose of parallel connection with respect to the input terminal or the output terminal, and a method of mixing the parallel connection and serial connection can also be used. Here, the diode connected in series to the input terminal or the output terminal may have one end connected to the input terminal or the output terminal and the other end connected to the transmission line.

In accordance with the present invention, an RF switch, which can be miniaturized by employing a CRLH transmission line as a transmission line, while having a high linearity and a high degree of isolation even at a high power, and a short switching time through a PIN diode, and has a dual band characteristic, can be designed.

In accordance with the present invention, an RF switch, which can implement a high degree of isolation even in the SPST structure as well as the SPDT structure and can be miniaturized even at a single frequency band, can be designed.

BRIEF DESCRIPTION OF THE DRAWINGS

Further objects and advantages of the invention can be more fully understood from the following detailed description taken in conjunction with the accompanying drawings in which:

FIGS. 1 to 3 are examples showing a conventional RF switch;

FIG. 4 is an example showing another conventional RF switch of a SPDT structure employing a PIN diode;

FIG. 5 is a view illustrating the structure of an RF switch constructed by employing a CRLH transmission line in accordance with an embodiment of the present invention;

FIG. 6 is a view illustrating an internal structure of a cell constituting the CRLH transmission line in accordance with an embodiment of the present invention;

FIG. 7 is a view illustrating a change in the phase depending on the frequency of the CRLH transmission line; and FIG. 8 is a view illustrating the structure of an RF switch constructed by employing a CRLH transmission line in accordance with another embodiment of the present invention.

DETAILED DESCRIPTION

The present invention will now be described in detail in connection with various embodiments with reference to the accompanying drawings. The present invention relates to an RF switch employing a PIN diode and a CRLH transmission line and an apparatus including the RF switch. In the specification, an "apparatus" refers to an apparatus that transmits and receives RF signals and can include all kinds of radio transmitters, radio receivers and radio transceivers. Further, the contents regarding a bias, etc. for operating the PIN diode have already been described in the section [Background Art] and are well known to those having ordinary skill in the art and description thereof is omitted in describing the embodiments of the present invention.

FIG. 5 is a view illustrating the structure of an RF switch constructed by employing a CRLH transmission line in accordance with an embodiment of the present invention. As shown in FIG. 5, an RF switch 300 that switches the input and output of an RF signal includes a first transmission line 304 having one end connected to an input terminal 301 and the other end connected to a signal line 303 of an antenna 302 so as to transmit an RF signal, a second transmission line 306 having one end connected to an output terminal 305 and the other end connected to the signal line 303 so as to transmit the RF signal, a first PIN diode 307 connected between the input terminal 301 and the first transmission line 304 and configured to control whether or not to transmit the RF signal, and a second PIN diode 308 connected between the output terminal 305 and the second transmission line 306 and configured to control whether or not to transmit the RF signal. Here, a CRLH transmission line can be used as the first transmission line 304 and the second transmission line 306.

This CRLH transmission line can include at least one cell, which can be equalized through a combination of a RH transmission line including two serial inductors and a parallel capacitor, and a LH transmission line including two serial capacitors and a parallel inductor. Here, the RH transmission line can generate positive phase delay at a high frequency band with respect to an input signal, and the LH transmission line can generate negative phase delay at a low frequency band with respect to the input signal. That is, desired phase delay can be generated by changing the number of the cell including the CRLH transmission line. Through this, an RF switch can be designed to have a dual band characteristic.

Further, the first PIN diode 307 and the second PIN diode 308 can be connected in parallel to the input terminal 301 and the output terminal 305, respectively. For example, in FIG. 5, it can be seen that the first PIN diode 307 has one end connected to the input terminal 301 and the other end connected to a ground 309. Further, as described above and as shown in FIG. 3, the PIN diodes 307, 308 of the RF switch 300 can also be used by mixing a parallel diode and a serial diode.

In other words, the embodiment of FIG. 5 presents a preferred embodiment of the present invention, and it is evident that the embodiment of FIG. 5 can be modified in various ways. For example, in the embodiment of FIG. 5, the RF switch of the SPDT structure has been described. However, the structure employing the PIN diode and the CRLH transmission line as described above can also be applied to the SPST structure, and a higher degree of isolation can be implemented by multi-connecting the PIN diodes. In addition, this structure is advantageous in not only a dual band, but also miniaturization even in the design of a single frequency band. The CRLH transmission line is described below in more detail with reference to FIG. 6.

FIG. 6 is a view illustrating an internal structure of a cell constituting the CRLH transmission line in accordance with an embodiment of the present invention. A cell 400 is largely comprised of a combination of a LH transmission line 401, including two serial capacitors and a parallel inductor, and a RH transmission line 402, including two serial inductors and a parallel capacitor. Here, the RH transmission line 402 can be implemented using a transmission line, that is, a distributed element such as a micro strip, and the LH transmission line 401 can be implemented using a LC lumped element. For the purpose of excellent performance implementation, the size of the cell 400 is preferably ¼ or less of a guided wavelength.

The cell 400, as shown in FIG. 6, can have a propagation constant βCRLH, which is approximately expressed in the following Equation 1 as the sum of the propagation constants of the RH transmission line and the LH transmission line.

$$\beta_{CRLH} = \omega\sqrt{L_{RH}C_{RH}} + \frac{-1}{\omega\sqrt{L_{LH}C_{LH}}d} \quad \text{[Equation 1]}$$

where, ω denotes an angular frequency, $L_{RH}$ denotes the inductance of the RH transmission line, and $C_{RH}$ denotes the capacitance of the RH transmission line. Further, $L_{LH}$ denotes the inductance of the LH transmission line and $C_{LH}$ denotes the capacitance of the LH transmission line.

From the above formula, it can be seen that when the frequency is low, $L_{LH}$ and $C_{LH}$ have a dominant influence, and when the frequency is high, $L_{RH}$ and $C_{RH}$ have a dominant influence. Thus, when the frequency is low, negative phase delay (−90 degrees) by the LH transmission line is generally used, and when the frequency is high, positive phase delay (90 degrees) by the RH transmission line is generally used, so phase delay necessary both for two bands can be accomplished. In particular, at a low frequency band, phase progress is realized by the LH transmission line. Thus, the length of the transmission line is decided irrespective of a wavelength unlike the prior art, and can become ¼ or less of that of a low frequency signal. In contrast, at a high frequency, phase delay is generally realized by the RH transmission line. Thus, the length of the transmission line can become ¼ of a high frequency signal wavelength. However, since the wavelength of a low frequency signal is longer than that of a high frequency signal, a circuit can be still minimized through the use of the LH transmission line. This description is a very simplified one and a LH line and a RH line are operated substantially very complexly. This is described later one.

FIG. 7 is a view illustrating a change in the phase depending on the frequency of the CRLH transmission line. As can be seen from a graph 500, a phase 501 with respect to the frequency of the CRLH transmission line can be expressed in the sum of a phase 502 of the LH transmission line and a phase 503 of the RH transmission line. An RF switch can be designed to have the phases of +90 degrees and −90 degrees by employing this characteristic. The inductance and capacitance of the RH transmission line and the LH transmission line, the length of the CRLH transmission line, and the number of cells N constituting the CRLH transmission line, which make a phase delay ΦCRLH
have 90 degrees (π/2) or −90 degrees (−π/2) in two use frequencies, can be decided based on the Equation 1. A change in the phase depending on this phase delay can be expressed in the following Equation 2.

$$\Delta\phi_{CRLH} = -\beta_{RH}d + \beta_{LH} = \Delta\phi_{RH} + \Delta\phi\beta_{LH} \quad \text{[Equation 2]}$$

Analysis into the cell 400 of this CRLH transmission line is identical to that of a CRLH transmission line. A specific dual band, which could not be designed using a general RH transmission line, can be designed through the number of cells N. That is, a dual band transmission line employing the CRLH transmission line can be designed so that a change in the phase depending on the frequency is represented as the sum of phases of the RH transmission line and the LH transmission line and a phase value, substantially having the same operating characteristic in different frequencies $f_1$ and $f_2$, can be obtained. This characteristic of the CRLH transmission line is expressed in the following Equation 3.

$$\phi_{CRLH}(f_1) = \phi_{RH}(f_1) + \phi\beta_{LH}(f_1) = \phi_1$$

$$\phi_{CRLH}(f_2) = \phi_{RH}(f_2) + \phi\beta_{LH}(f_2) = \phi_2 \quad \text{[Equation 3]}$$

That is, the RF switch employing this characteristic of the CRLH transmission line in accordance with the present invention can be designed to have +90 degrees at a design frequency $f_1$ and −90 degrees at a design frequency $f_2$. Through this, the inductance $L_{LH}$ and the capacitance $C_{LH}$ of the LH transmission line can be expressed in the following Equation 4 and Equation 5, respectively, through the Equation 3.

$$L_{LH} = \frac{N \cdot Z_0\left\{1 - \left(\frac{f_1}{f_2}\right)^2\right\}}{2\pi \cdot f_1\left\{\frac{\pi}{2} + \left(\frac{\pi}{2} \cdot \frac{f_1}{f_2}\right)\right\}} \quad \text{[Equation 4]}$$

$$C_{LH} = \frac{N\left\{1 - \left(\frac{f_1}{f_2}\right)\right\}}{2\pi \cdot Z_0\left\{\frac{\pi}{2} + \left(\frac{\pi}{2} \cdot \frac{f_1}{f_2}\right)\right\}} \quad \text{[Equation 5]}$$

where $f_1 < f_2$.

The phase of the RH transmission line can also be found by substituting the Equations 4 and 5 into the Equation 3. The design frequencies $f_1$ and $f_2$ can be designed to have, for example, 880 MHz of the GSM band and 1.8 MHz of the PCS band.

FIG. 8 is a view illustrating the structure of an RF switch constructed by employing a CRLH transmission line in accordance with another embodiment of the present invention. An RF switch 600 is a switch of the SPST structure and is used to transfer an RF signal between an input terminal 601 and an output terminal 602. This RF switch 600 includes a transmission line 603 having one end connected to the input terminal 601 and the other end connected to the output terminal 602, a first PIN diode 604 disposed between the input terminal 601 and the transmission line 603 so as to control whether or not to transfer the RF signal, and a second PIN diode 605 disposed between the output terminal 602 and the transmission line 603 so as to control whether or not to transfer the RF signal. Here, the transmission line 603 employs the CRLH transmission line in the same manner as the RF switch of the SPDT structure as described above.

The CRLH transmission line can include at least one cell, which can be equalized through a combination of a RH transmission line including two serial inductors and a parallel capacitor, and a LH transmission line including two serial capacitors and a parallel inductor. Further, the RH transmission line can generate positive phase delay at a high frequency band with respect to an input signal, and the LH transmission line can generate negative phase delay at a low frequency band with respect to the input signal. In other words, as described above through the Equation 1, even in the SPST structure, phase delay is generally implemented by the RH transmission line with respect to a high frequency in the same manner as the SPDT structure. The length of the transmission line becomes ¼ of the wavelength of the high frequency signal, but the wavelength of the high frequency signal is shorter than that of the low frequency signal. Accordingly, a circuit can be minimized by employing the LH transmission line and desired phase delay can be designed, so a circuit operating in the same manner at a specific dual band can be designed.

The first PIN diode 604 and the second PIN diode 605 can also employ parallel connection in the same manner as the SPDT structure or a combination of the parallel connection and serial connection. If the parallel connection is employed as shown in FIG. 8, for example, the first PIN diode 604 has one end connected to the input terminal 601 and the other end connected to a ground 606 and, therefore, can permit or reject the transfer of the RF signal between the input terminal 601 and the output terminal 602. The method of allowing the first PIN diode 604 and the second PIN diode 605 to determine whether or not to transfer the RF signal has already been described above in detail and description thereof is omitted.

As described above, an RF switch, which can be miniaturized by employing a CRLH transmission line as a transmission line, while having a high linearity and a high degree of isolation even at a high power, and a short switching time through a PIN diode, and has a dual band characteristic, can be designed. Further, an RF switch, which can implement a high degree of isolation even in the SPST structure as well as the SPDT structure and can be miniaturized even at a single frequency band, can be designed.

Therefore, the scope of the present invention is not limited by or to the embodiments as described above, and should be construed to be defined only by the appended claims and their equivalents.

What is claimed is:

1. A radio frequency (RF) switch that switches an input and output of an RF signal, the RF switch comprising:

a transmission line having one end connected to an input terminal or an output terminal and the other end connected to a signal line, transmission line being configured to transmit the RF signal; and a diode disposed between the input terminal and the transmission line or between the output terminal and the transmission line, the diode being configured to control whether or not to transmit the RF signal, wherein a CRLH (Composite Right/Left-handed) transmission line is employed as the transmission line.

2. An RF switch that permits transfer of an RF signal between an input terminal and an output terminal, the RF switch comprising:

a transmission line having one end connected to the input terminal and the other end connected to the output terminal; and a diode disposed between the input terminal and the transmission line or between the output terminal and the transmission line, the diode being configured to control whether or not to transmit the RF signal, wherein a CRLH transmission line is employed as the transmission line.

3. The RF switch of claim 1, wherein the CRLH transmission line comprises at least one cell that can be equalized through a combination of a RH transmission line including two serial inductors and a parallel capacitor, and a LH transmission line including two serial capacitors and a parallel inductor.

4. The RF switch of claim 3, wherein:

the RH transmission line generates a positive phase delay at a high frequency band with respect to an input signal, and the LH transmission line generates a negative phase delay at a low frequency band with respect to the input signal.

5. The RF switch of claim 1, wherein the CRLH transmission line has an absolute value of phase delay of 90 degrees with respect to two or more frequencies.

6. The RF switch of claim 1, wherein the diode has one end connected to the transmission line and the other end connected to a ground.

7. The RF switch of claim 1, wherein the diode has one end connected to the input terminal or the output terminal and the other end connected to the transmission line.

8. An apparatus comprising a radio frequency switch that switches an input and output of an RF signal, the RF switch comprising:

a transmission line having one end connected to an input terminal or an output terminal and the other end connected to a signal line, transmission line being configured to transmit the RF signal; and a diode disposed between the input terminal and the transmission line or between the output terminal and the transmission line, the diode being configured to control whether or not to transmit the RF signal, wherein a CRLH (Composite Right:Left-handed) transmission line is employed as the transmission line.

* * * * *